United States Patent [19]

Blowsky et al.

[11] 4,211,405

[45] Jul. 8, 1980

[54] PHYSICAL EXERCISING DEVICE

[76] Inventors: Frank C. Blowsky, 46-16 195th St., New York, N.Y. 11358; Kenneth B. Glickman, 11 Waverly Pl., New York, N.Y. 10003; Alan D. Iscoe, 154-36 Horace Harding Blvd., Flushing, N.Y. 11367

[21] Appl. No.: 905,236

[22] Filed: May 12, 1978

[51] Int. Cl.[2] ..... A63B 21/00

[52] U.S. Cl. ..... 272/141

[58] Field of Search ..... 272/134–141, 272/130; 73/379, 380

[56] References Cited

U.S. PATENT DOCUMENTS

| | | | |
|---|---|---|---|
| 1,023,756 | 4/1912 | Pons | 272/141 |
| 2,106,994 | 2/1938 | Chapman | 272/141 X |
| 3,759,514 | 9/1973 | Cox | 272/141 X |
| 3,938,803 | 2/1976 | Wilmoth et al. | 272/141 X |

FOREIGN PATENT DOCUMENTS

| | | | |
|---|---|---|---|
| 968180 | 8/1964 | United Kingdom | 272/141 |
| 1344828 | 1/1974 | United Kingdom | 272/141 |
| 1365888 | 9/1974 | United Kingdom | 272/141 |

*Primary Examiner*—Richard J. Apley
*Attorney, Agent, or Firm*—Milton Wolson

[57] ABSTRACT

A physical exercising device having a design which permits it to be manufactured in a small, compact configuration. Means are provided which enable the exerciser to perform both pulling and pushing exercises. During pushing exercises, the exerciser pushes inwardly against handle members causing a compression spring to be compressed. In pulling exercisers, pull members are pulled outwardly and away from each other. The pull members are attached to opposite handle members in such a manner that outward movement of the pull members causes the compression spring to be compressed. In a preferred embodiment the pull member includes a rigid rod having a grip portion.

16 Claims, 4 Drawing Figures

PHYSICAL EXERCISING DEVICE

CROSS-REFERENCES TO RELATED APPLICATIONS

There are no previously filed pending patent applications related to the present application. A patent application entitled "Telescoping Physical Exercising Device", in which the applicants are Kenneth Glickman and Frank Blowsky, is being filed on the same date as the present application.

Background of the Invention (1) Field of the Invention

The field of this invention is physical exercising devices.

(2) Description of the Prior Art

It has long been known in the prior art that pushing exercises may be performed by means of a device in which the exerciser pushes against the force of a compression spring. Such a device is shown in U.S. Pat. No. 2,106,994 and U.S. Pat. No. 2,132,862.

Later patents disclosed more versatile physical exercising devices in which both pushing and pulling exercises are accomplished by compressing a compression spring. Examples of this type of device are U.S. Pat. Nos. 3,268,225 and 3,746,339. In these types of devices, pulling exercises are accomplished by pulling ropes which compress a compression spring located in the exercising device.

Another exercising device wherein both pushing and pulling exercises are accomplished by compressing a compression spring is shown in British Pat. No. 1,365,888. However, in addition to other differences between the exercising device shown in this British patent and the present invention, the British patent exercising device has a hand grip 21 which is permanently mounted at a right angle to the tubular casing, causing the exercising device of the British patent to have a large, bulky configuration as compared to the small, compact configuration which may be achieved by the exercising device of the present invention.

An early British Pat. No. 11,675 (1892) illustrates a form of pull rod used to compress a compressing spring in an apparatus for use in performance of physical strength and endurance.

SUMMARY OF THE INVENTION

There is at the present time a great interest in physical fitness and the use of physical exercising devices to achieve such fitness. Physical exercises are performed at home, in the office and wherever an opportunity occurs. For this reason it is highly desirable to provide a small, compact versatile exercising device which may be readily transported and quickly assembled for use. The compact, versatile portable exercising device embodying the present invention may be produced in a size to fit within an attache case, and used by the exerciser even while commuting to and from his office. Although the discussion of the exercising device has referred to the smallness of the device, it will be appreciated that the invention set forth in the present application is intended to cover any exercising device, regardless of size, which embodies the inventive concept set forth herein.

The preferred embodiment of the present invention consists in general of three components. A first component comprises a compression spring unit in which a compression spring is located within a housing. Handle members, which are part of the housing, are located at each end of the compression spring. During pushing exercises, the exerciser pushes the handle members together to compress the compression spring.

The other two components of the present invention are used for pulling exercises. In a preferred embodiment the two pulling components comprise pull rods which are attached to opposite handle members when it is desired to do pulling exercises. In the pulling exercise, the exerciser pulls the pull rods outwardly away from the housing unit; and the outward movement of the pull rods causes the attached handle members to compress the compression spring.

BRIEF DESCRIPTION OF THE DRAWING

In the accompanying drawing.

DESCRIPTION OF THE PREFERRED EMBODIMENTS

Figure 1:
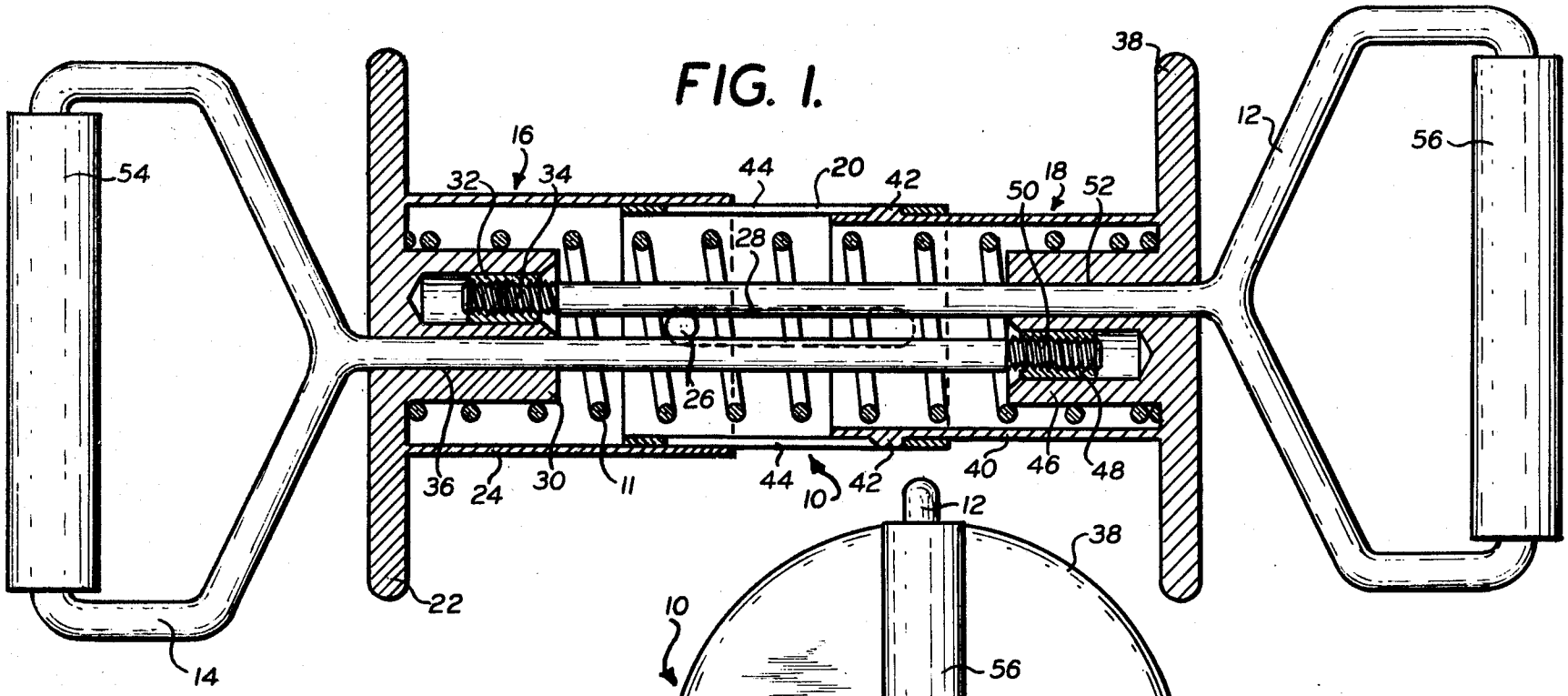
FIG. 1 is a longitudinal section of a first embodiment of the present invention.

There is shown in FIG. 1, an exercising device comprising three components. A first component is a compression spring unit designated generally by the numeral 10. The other two components are pull rods; one of which is designated by the numeral 12 and the other of which is designated by the numeral 14.

Within the compression spring unit 10 is a compression spring 11 which biases a first handle member shown generally as 16 away from a second handle member shown generally as 18. First handle member 16 is adapted to slide over intermediate member 20, and second handle member 18 is adapted to slide within intermediate member 20.

First handle member 16 comprises a handle portion 22 which may be in the form of a circular disc. A cover portion 24 shown as a cylindrical member is integral with the inner face of handle portion 22. Two stop members 26 (only one of which is illustrated in the drawing) extend from the interior surface of cover portion 24 into openings 28 (only one of which is illustrated in the drawing) in intermediate member 20.

A pull rod receiving member 30 located within cover portion 24, is shown integral with the interior face of handle portion 22. The outer diameter of pull rod receiving member 30 is slightly smaller than the inner diameter of compression spring 11, so that an end of compression spring 11 may be journalled around and supported by pull rod receiving member 30, in such a manner that compression spring 11 biases handle portion 22 to the left.

A threaded member 32 in pull rod receiving member 30 is adapted to receive the threaded end 34 of pull rod 12. An opening 36 extends through pull rod receiving member 30 and handle portion 22. When it is desired to perform pulling exercises, pull rod 14 is inserted through opening 36 and into threaded engagement with second handle member 18 in a manner to be hereinafter described.

Second handle member 18 is generally similar to first handle member 16 and comprises a handle portion 38 which may be in the form of a circular disc. A cover portion 40 shown as a cylindrical member is integral with the inner face of handle portion 38. In the illustrated embodiment cover portion 40 is shown to be the same length as cover portion 24. Two stop members 42 extend from the exterior surface of cover portion 40 into openings 44 in intermediate member 20.

A pull rod receiving member 46 located within cover portion 40 is shown integral with the interior face of handle portion 38. The outer diameter of pull rod receiving member 46 is slightly smaller than the inner diameter of compression spring 11, so that an end of compression spring 11 may be journalled around and supported by pull rod receiving member 46, in such a manner that compression spring 11 biases handle portion 38 to the right.

A threaded member 48 in pull rod receiving member 46 is adapted to receive the threaded end 50 of pull rod 14. An opening 52 extends through pull rod receiving member 46 and handle portion 38. When it is desired to perform pulling exercises, pull rod 12 is inserted through opening 52 and into threaded engagement with the threaded opening 32 of first handle member 16.

When the exercising device is at rest compression spring 11 biases first handle member 16 to the left and second handle member 18 to the right. The leftward movement of first handle member 16 is limited by engagement of two stop members 26 of the first handle member 16 with the left-hand ends of openings 28 in intermediate member 20. The rightward movement of second handle member 18 is limited by engagement of the stop members 42 of the second handle member with the right-hand ends of openings 44 in intermediate member 20.

It should be noted that the pull rods 12 and 14 are not assembled into the compression spring unit 10 when it is desired to perform pushing exercises. For pushing exercises, the exerciser pushes first handle member 16 and second handle member 18 toward each other against the biasing force of compression spring 11. As the exerciser pushes the handle members toward each other, first handle member 16 slides over intermediate member 20 and second handle member 18 slides within intermediate member 20.

The rightward movement of first handle member 16 over intermediate member 20 is limited by the abutment of cover portion 24 with the inner face of handle portion 38. The leftward movement of second handle member 18 inside intermediate member 20 is limited by the abutment of cover portion 40 with the inner face of handle portion 22. It should be noted in this connection that if the cover portion 24 is longer than the cover portion 40, then both the rightward movement of first handle member 16 over intermediate member 20 and the leftward movement of second handle member 18 inside of intermediate member 20, will be limited by the abutment of cover portion 24 with the inner face of handle portion 38. Conversely, if the cover portion 40 is longer than the cover portion 24 then both the rightward movement of first handle member 16 over intermediate member 20 and the leftward movement of second handle member 18 inside of intermediate member 20 will be limited by the abutment of cover portion 40 with the inner face of handle portion 22.

After the exerciser pushes the first handle member 16 and second handle member 18 towards each other to the extent possible, the exerciser releases the applied pushing forces and the compressive spring 11 will return the exercising device to the rest position. The exercising device is then ready to be used for further exercise.

For pulling exercises the threaded end 50 of pull rod 14 is inserted through opening 36 in first handle member 16, and is then screwed into threaded member 48 in pull rod receiving member 46 of the second handle member 18. Likewise the threaded end 34 of pull rod 12 is inserted through opening 52 in second handle member 18, and is then screwed into threaded member 32 in pull rod receiving member 30 of the first handle member 16. During the pulling exercise the exerciser places one hand around a grip portion 54 of pull rod 14, and the other hand around a grip portion 56 of pull rod 12. The exerciser then pulls the grip portion 54 to the left and the grip portion 56 to the right. Pulling grip portion 54 and thereby pull rod 14 to the left, causes the second handle member 18 (to which pull rod 14 is attached) to move leftward against the force of compression spring 11. Pulling grip portion 56 and thereby pull rod 12 to the right, causes the first handle member 16 (to which the pull rod 12 is attached) to move rightward against the force of compression spring 11.

Thus it will be observed that pulling grip portion 54 of pull rod 14 to the left, and pulling grip portion 56 of pull rod 12 to the right, will act to compress the compression spring unit 10 in the same manner as in the previously discussed pushing exercise.

After the exerciser pulls pull rod 14 to the left and pull rod 12 to the right to the extent possible, the exerciser releases the applied pulling forces, and the compressive spring 11 will return the exercising device to the rest position. The exercising device is then ready to be used for further exercise.

Figure 2:
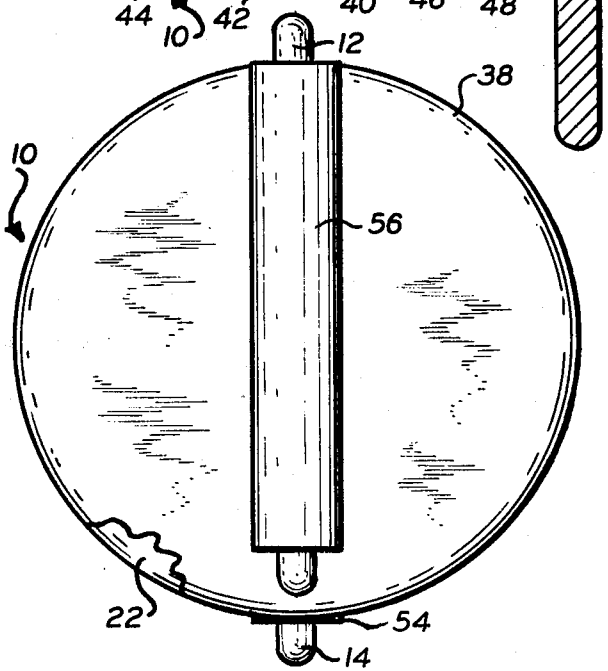
FIG. 2 is an external end view of the invention shown in FIG. 1.
Figure 3:
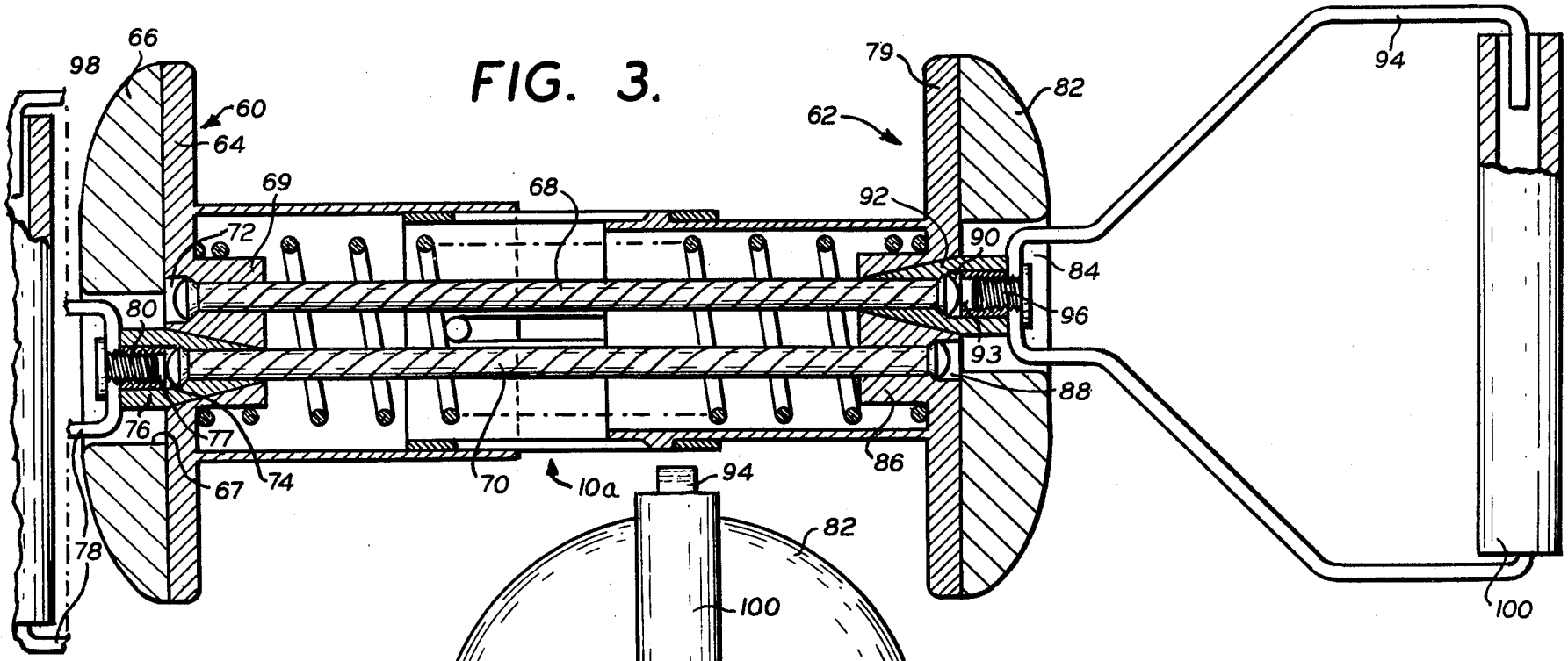
FIG. 3 is a longitudinal section of another embodiment of the present invention and FIG. 4 is an external end view of the invention shown in FIG. 3.
Figure 4:
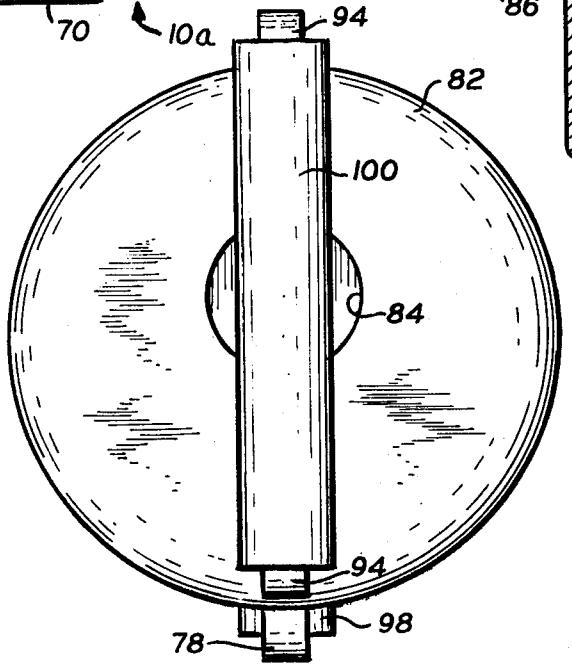

The embodiment of the invention illustrated in FIGS. 3 and 4 is similar in many respects to the invention illustrated in FIGS. 1 and 2 and therefore, for brevity purposes, only the structure of the FIGS. 3 and 4 embodiment which is dissimilar to the structure of the FIGS. 1 and 2 embodiment will be described in detail. Accordingly, all structure of the FIGS. 3 and 4 embodiment not hereinafter described should be presumed to be identical with similar structure in the FIGS. 1 and 2 embodiment.

With respect to the FIGS. 3 and 4 embodiment, the compression spring unit **10*a* consists of a first handle member 60 and a second handle member 62**.

First handle member 60 comprises a handle portion 64 which may be in the form of a circular disc. A cushioning means 66 formed of a suitable material and having an opening 67 therein, is attached to the handle portion 64. A cover portion and stop members identical to the cover portion and stop members present in the first handle member 16 of the FIG. 1 embodiment, are also present in the FIG. 3 embodiment.

A pull rope receiving member 69 integral with the interior face of handle portion 64 is located within the cover portion of first handle member 60. As in the FIG. 1 embodiment, the outer diameter of pull rope receiving member 69 is slightly smaller than the inner diameter of the compression spring included in compression spring unit **10*a*, so that an end of the compression spring may be journalled around and supported by pull rope receiving member 69**.

The compression spring unit **10*a* also includes two rope members 68 and 70. Rope member 68 is anchored in an opening 72 in handle portion 64 in such a manner that movement of rope member 70 to the right causes handle portion 64 to be moved to the right. Rope member 70 is anchored in an opening 74 in a moveable hand grip receiving section 76 which is located in both handle portion 64 and pull rope receiving member 69. In the embodiment illustrated in FIG. 3, hand grip receiving section 76 surrounds a portion of one end of rope member 70**.

Hand grip receiving section 76 contains a threaded portion 77 into which a hand grip member 78 having a threaded end 80 is threaded, when it is desired to perform pulling exercises. When hand grip 78 is inserted into hand grip receiving section 76, it will be in substantial alignment with the axis of rope member 70.

Second handle member 62 comprises a handle portion 79 which may be in the form of a circular disc. A cushioning means 82 formed of a suitable material and having an opening 84 therein is attached to the handle portion 79. A cover portion and tab members identical to the cover portion and tab members present in the second handle member 18 of the FIG. 1 embodiment are also present in the FIG. 3 embodiment.

A pull rope receiving member 86 integral with the interior face of handle portion 79 is located within the cover portion of second handle member 62. As in the FIG. 1 embodiment the outer diameter of pull rope receiving member 86 is slightly smaller than the inner diameter of the compression spring included in compression spring unit 10*a*, so that an end of the compression spring may be journalled around and supported by pull rope receiving member 86.

Previously described rope member 70 is anchored in an opening 88 in handle portion 79 in such a manner that movement of rope member 70 to the left causes handle portion 79 to be moved to the left. Rope member 68 is anchored in an opening 90 in a moveable hand grip receiving section 92 located in both handle portion 79 and pull rope receiving member 86. In the embodiment illustrated in FIG. 3, hand grip receiving station 92 surrounds a portion of one end of rope member 68.

Hand grip receiving station 92 contains a threaded portion 93 into which a hand grip member 94 having a threaded end 96 is threaded, when it is desired to perform pulling exercises. When hand grip member 94 is inserted into hand grip receiving section 92, it will be in substantial alignment with the axis of rope member 68.

The hand grip members 78 and 94 are not inserted into their respective hand grip receiving members when it is desired to perform pushing exercises. For pushing exercises, the exerciser pushes first handle member 60 and second handle member 62 toward each other in the same manner as previously discussed with respect to the FIG. 1 embodiment, and the operation and function of the exerciser of the FIG. 3 embodiment in the pushing exercise mode is the same as the previously discussed operation and function of the exerciser of the FIG. 1 embodiment.

For pulling exercises, the threaded end 80 of hand grip member 78 is threaded into the threaded portion 77 of hand grip receiving section 76 in first handle member 60. Likewise the threaded end 96 of hand grip member 94 is threaded into the threaded portion 93 of hand grip receiving section 92 in second handle member 62.

During the pulling exercise, the exerciser places one hand around a grip portion 98 of hand grip member 78, and the other hand around a grip portion 100 of hand grip member 94. The exerciser then pulls the grip portion 98 to the left and the grip portion 100 to the right.

Pulling grip portion 98 to the left also moves rope member 70 to the left, which in turn causes the second handle member 62 to move leftward against the force of the compression spring in compression spring unit 10*a*. Pulling grip portion 100 to the right also moves rope member 68 to the right, which in turn causes the first handle member 60 to move rightward against the force of the compression spring in compression spring unit 10*a*.

Thus it will be observed that pulling grip portion 98 of hand grip member 78 to the left, and pulling grip portion 100 of hand grip member 94 to the right, will compress the compression spring in the compression spring unit 10*a* in the same manner as in the previously discussed pushing exercise.

The relationships between the intermediate member, stop members and tab members in the FIG. 3 embodiment is the same as the relationship of these members in the FIG. 1 embodiment.

After the exerciser pulls hand grip member 78 to the left and hand grip member 94 to the right to the extent possible, the exerciser releases the applied pulling forces, and the compressive spring will return the exercising device to the rest position. The devise is then ready to be used for further exercises.

Although the present invention has been described and illustrated in connection with preferred embodiments, it is to be understood that modifications and variations may be resorted to without departing from the spirit of the invention, as those skilled in this art will readily understand. Such modifications and variations are considered to be within the preview and scope of the present invention as defined by the appended claims.

Having described the present invention, I claim:

1. A physical exercising device comprising:

a first member;

a second member;

a compression spring located between the first and second members so that the compression spring will be compressed when the first member and second member are caused to be moved with respect to each other; a first pull member having one free end and the other end secured to the second member, and a second pull member having one free end and the other end secured to the first member.

2. A physical exercising device as set forth in claim 1 wherein said first and second members are handle members.

3. A physical exercising device as set forth in claim 1 wherein said first pull member is removably secured to the second handle, so that when a pulling force is applied to the first pull member it will cause the second handle member to move with respect to said first handle member and compress the compression spring, and wherein the second pull member is removably secured to the first handle, so that when a pulling force is applied to the second pull member it will cause the first handle member to move with respect to said second handle member and compress the compression spring.

4. A physical exercising device as set forth in claim 1 wherein said first and second members include cover portions which surround the compression spring.

5. A physical exercising device as set forth in claim 1 wherein said pull members are pull rods having grip portions and means which are adopted to be removably secured to pull rod receiving portions in said handle members.

6. A physical exercising device as set forth in claim 5 wherein the pull rod means are threaded end portions adopted to be removably secured to threaded pull rod receiving portions in said handle members.

7. A physical exercising device as set forth in claim 1 wherein the first pull member extends through an opening in the first member and the second pull member extends through an opening in the second member.

8. A physical exercising device as set forth in claim 1 wherein said first and second pull members are removable.

9. A physical exercising device as set forth in claim 1 wherein the first member and second member have openings therethrough.

10. A physical exercising device comprising:

a first handle member;

a second handle member;

a compression spring located between the first and second handle members so that the compression spring will be compressed when the first handle member and second handle member are caused to be moved with respect to each other;

a first pull member having a hand grip and having one free end and the other end secured to the second member, and a second pull member having a hand grip and having one free end and the other end secured to the first member.

11. A physical exercising device as set forth in claim 10 wherein the first pull member hand grip and the second pull member hand grip are each removable.

12. A physical exercising device as set forth in claim 11 wherein the first pull member hand grip and second pull member hand grip contain threaded portions so that the first pull member hand grip and second pull member hand grip may each be threaded into hand grip receiving sections.

13. A physical exercising device as set forth in claim 12 therein a first movable hand grip receiving section is located in the opening in said first handle members and a second movable hand grip receiving section located in the opening in said second handle member.

14. A physical exercising device as set forth in claim 10 wherein said first and second handle members have openings therethrough.

15. A physical exercising device as set forth in claim 14 wherein the first pull member comprises a first rope having one end connected to the second handle member and the other end connected to the first hand grip receiving section and a second rope having one end connected to the first handle member and the other end connected to the second hand grip receiving section.

16. A physical exercising device as set forth in claim 10 wherein said first and second handle members include cover portions which surround the compression spring.

* * * * *